US010185270B2

(12) United States Patent
Kawada et al.

(10) Patent No.: US 10,185,270 B2
(45) Date of Patent: Jan. 22, 2019

(54) IMAGE FORMING APPARATUS WHICH DETERMINES A TONER SUPPLYING AMOUNT BASED ON PREDICTED TONER CONSUMPTION AND PREDICTED DENSITY OF STORED TONER, TONER SUPPLY METHOD, AND NON-TRANSITORY COMPUTER-READABLE RECORDING MEDIUM ENCODED WITH TONER SUPPLY PROGRAM

(71) Applicant: KONICA MINOLTA, INC., Chiyoda-ku, Tokyo (JP)

(72) Inventors: Masanori Kawada, Toyokawa (JP); Hiroaki Umemoto, Neyagawa (JP); Yohei Ito, Toyokawa (JP); Toshiaki Shima, Sanda (JP); Kazuyoshi Ota, Chiryu (JP); Shinya Tokutake, Okazaki (JP); Hidetoshi Noguchi, Tahara (JP); Shinichi Yoshimoto, Toyohashi (JP); Futoshi Okazaki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/704,950

(22) Filed: Sep. 14, 2017

(65) Prior Publication Data

US 2018/0088508 A1 Mar. 29, 2018

(30) Foreign Application Priority Data

Sep. 23, 2016 (JP) ..... 2016-185544

(51) Int. Cl.
*G03G 15/08* (2006.01)
*G03G 15/00* (2006.01)

(52) U.S. Cl.
CPC ..... *G03G 15/556* (2013.01); *G03G 15/0879* (2013.01)

(58) Field of Classification Search
CPC ..... G03G 15/556
(Continued)

(56) References Cited

U.S. PATENT DOCUMENTS

2007/0177888 A1 8/2007 Ishida

FOREIGN PATENT DOCUMENTS

| | | | |
|---|---|---|---|
| JP | 06258951 | A | 9/1994 |
| JP | 2001206458 | A | 8/2007 |
| JP | 2009186782 | A | 8/2009 |

OTHER PUBLICATIONS

Computer translation of JP06-258951A to Takerou, published Aug. 2007.*

* cited by examiner

*Primary Examiner* — Quana M Grainger
(74) *Attorney, Agent, or Firm* — Holtz, Holtz & Volek PC

(57) ABSTRACT

An image forming apparatus includes an image former which forms an image on an image carrying member with toner stored in a storage, a toner supplier which supplies toner to the storage by driving a conveyance member, a density measurer which causes the image former to form an image having a predetermined density at a predetermined timing and measures density of the formed image, a corrector which corrects a driving amount of the conveyance member based on the density measured by the density measurer, and a changer which changes a timing when the density measurer measures the density in response to an event that a predetermined condition is satisfied.

15 Claims, 10 Drawing Sheets

(58) Field of Classification Search
USPC ..... 399/27, 44, 49
See application file for complete search history.

FIG. 9

CHANGE ACCORDING TO REDUCED REMAINING AMOUNT

| | FOGGING RANK | CARRIER ADHESION RANK |
|---|---|---|
| CHANGED | 3 | 3 |
| UNCHANGED | 3 | 1 |

FIG. 10

CHANGE ACCORDING TO ENVIRONMENTAL CHANGE

| | FOGGING RANK | CARRIER ADHESION RANK |
|---|---|---|
| CHANGED | 3 | 3 |
| UNCHANGED | 1 | 1 |

FIG. 11

CHANGE ACCORDING TO NON-OPERATION STATE

| | FOGGING RANK | CARRIER ADHESION RANK |
|---|---|---|
| CHANGED | 3 | 3 |
| UNCHANGED | 3 | 1 |

IMAGE FORMING APPARATUS WHICH DETERMINES A TONER SUPPLYING AMOUNT BASED ON PREDICTED TONER CONSUMPTION AND PREDICTED DENSITY OF STORED TONER, TONER SUPPLY METHOD, AND NON-TRANSITORY COMPUTER-READABLE RECORDING MEDIUM ENCODED WITH TONER SUPPLY PROGRAM

Japanese Patent Application No. 2016-185544 filed on Sep. 23, 2016, including description, claims, drawings, and abstract, the entire disclosure is incorporated herein by reference in its entirety.

BACKGROUND

The present invention relates to an image forming apparatus, a toner supply method, and a non-transitory computer-readable recording medium encoded with a toner supply program. More specifically, the present invention relates to an image forming apparatus which forms an image on a sheet of paper by using a toner, a toner supply method which is executed by the image forming apparatus, and a non-transitory computer-readable recording medium encoded with a toner supply program which is executed by the image forming apparatus.

DESCRIPTION OF THE RELATED ART

Recently, an image processing apparatus represented by a multi function peripheral (hereinafter, referred to as an "MEP") includes a photoreceptor drum, a developing device which develops with toner an electrostatic latent image formed on the photoreceptor drum, and a sub hopper which supplies toner to the developing device. The developing device includes a storage which stores toner, and toner density in the storage influences printing quality. Therefore, it is necessary to maintain toner density in the storage within a predetermined range. There is known a controller which controls supplying from the sub hopper an amount of toner which is consumed by the developing device. Further, there is known a technology which provides in the storage a density sensor measuring toner density, and supplies toner from the sub hopper in order to keep toner density constant. However, there is a problem that the density sensor is required to be provided, which causes an increase in cost.

Meanwhile, Japanese Patent Laid-Open No. H6-258951 describes a toner density controlling method for an electrophotographic recording apparatus, the method including: forming a reference toner image on a photoreceptor; measuring toner density of the reference toner image by a sensor; based on the measured result, changing a toner supply interval to a developing chamber, and changing a reference toner image forming interval after comparing the measured result with a previous measured result; continuously recording while supplying toner at the changed toner supply interval; forming another reference tone image on the photoreceptor at the changed reference toner image forming interval; and repeating in the same way as mentioned, that is, measuring toner density of the reference toner image, changing the toner supply interval and the reference toner image forming interval, supplying toner, and forming the reference toner image.

However, a supply amount of toner supplied from the sub hopper to the storage is influenced by a state of toner stored in the sub hopper. There are some cases, for example, where an amount of toner stored in the sub hopper is decreased, and where liquidity of toner stored in the sub hopper is changed. According to a technique described in Japanese Patent Laid-Open No. H6-258951, there is a problem that it is difficult to maintain toner density in the storage to be an appropriate density in the case where the state of toner stored in the sub hopper is changed. Meanwhile, image quality to be output can be maintained by increasing a frequency of forming and measuring the reference toner image on the photoreceptor, however, this may consume much more toner for forming the reference toner image.

SUMMARY

According to an aspect of the present invention, an image processing apparatus includes: a storage that stores toner; an image former that forms an image on an image carrying member with toner stored in the storage; a toner supplier that supplies toner to the storage by driving a conveyance member; a density measurer that causes the image former to form an image having a predetermined density at a predetermined timing, and measures density of the formed image; a corrector that corrects, in response to measurement of density by the density measurer, a driving amount of the conveyance member based on the measured density; and a changer that changes, based on satisfaction of a predetermined condition, a timing when the density measurer measures density.

According to another aspect of the present invention, a toner supply method performed by an image forming apparatus includes: a storage that stores toner; an image former that forms an image on an image carrying member with toner stored in the storage; and a toner supplier that supplies toner to the storage by driving a conveyance member. The toner supply method includes: a density measuring step of causing the image former to form an image having a predetermined density at a predetermined timing, and measuring density of the formed image; a correction step of correcting, in response to measurement of density in the density measuring step, a driving amount of the conveyance member based on the measured density; and a change step of changing, based on satisfaction of a predetermined condition, a timing when density is measured in the density measuring step.

According to a further aspect of the present invention, a non-transitory computer-readable recording medium encoded with a toner supply program executed by a hardware processor that controls an image forming apparatus, the image forming apparatus includes: a storage that stores toner; an image former that forms an image on an image carrying member with toner stored in the storage; and a toner supplier that supplies toner to the storage by driving a conveyance member. The toner supply program causing the hardware processor performs: a density measuring step of causing the image former to form an image having a predetermined density at a predetermined timing, and measuring density of the formed image; a correction step of correcting, in response to measurement of density in the density measuring step, a driving amount of the conveyance member based on the measured density; and a change step of changing, based on satisfaction of a predetermined condition, a timing when density is measured in the density measuring step.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 9 is a first diagram showing an experiment result;

FIG. 10 is a second diagram showing an experiment result;

FIG. 11 is a third diagram showing an experiment result; and

DESCRIPTION OF THE PREFERRED EMBODIMENTS

Figure 1:
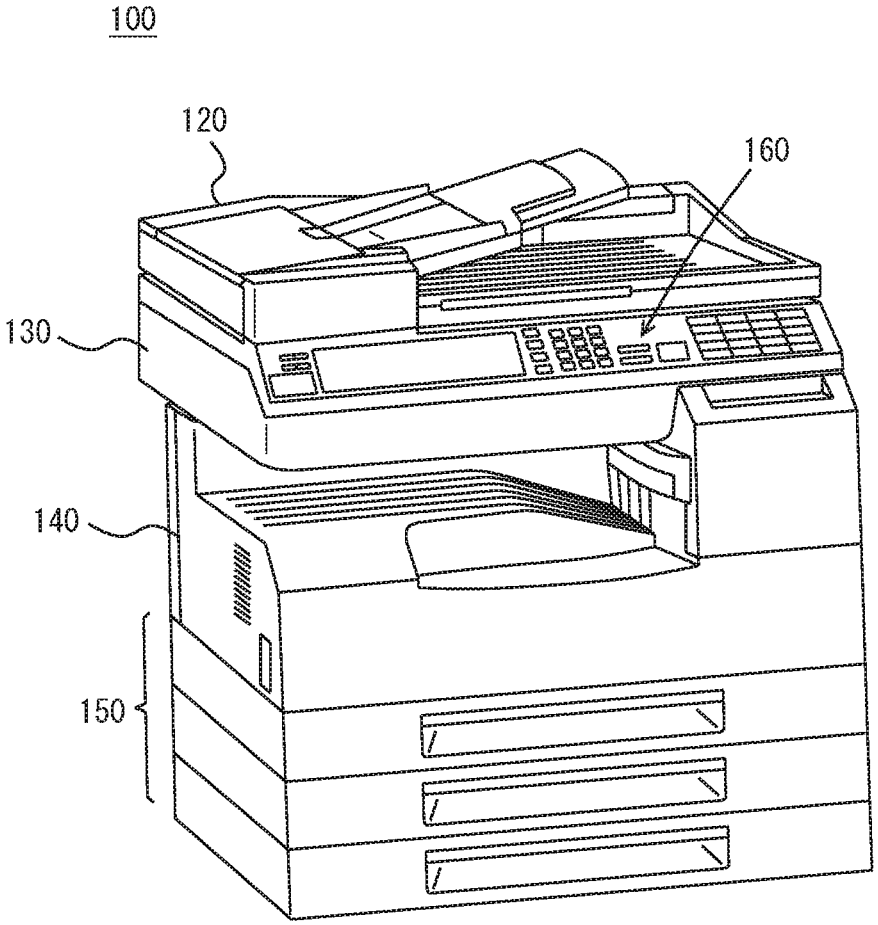
FIG. 1 is a perspective view showing an external appearance of an MFP according to one of embodiments of the present invention.

Hereinafter, one or more embodiments of the present invention will be described with reference to the drawings. However, the scope of the invention is not limited to the disclosed embodiments.

In the following description, the same or corresponding parts are denoted by the same reference characters. Their names and functions are also the same. Thus, a detailed description thereof will not be repeated.

Figure 2:
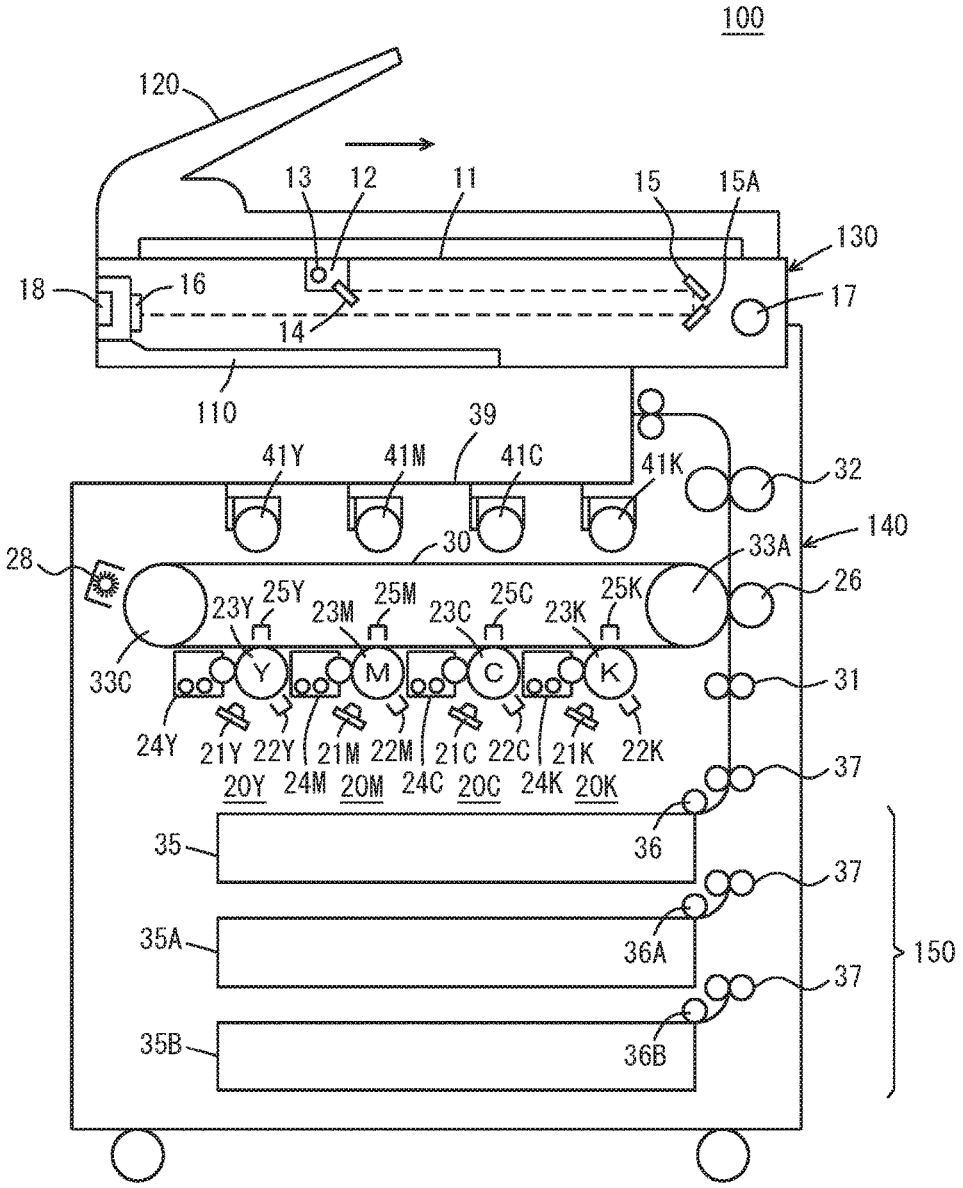
FIG. 2 is a cross-section view schematically showing an internal configuration of the MFP.

FIG. 1 is a perspective view showing an external appearance of a Multi Function Peripheral (hereinafter referred to as "MFP") according to one of embodiments of the present invention. FIG. 2 is a cross-section view schematically showing an internal configuration of the MFP. Referring to FIGS. 1 and 2, an MFP 100 includes: a document scanning unit 130 for scanning a document; an automatic document feeder 120 for conveying a document to the document scanning unit 130; an image forming unit 140 for forming on a sheet of paper and the like a still image output by the document scanning unit 130 scanning a document; a paper feed unit 150 for supplying sheets of paper to the image forming unit 140; and an operation panel 160 serving as a user interface.

The automatic document feeder 120 separates each of one or more documents placed on a document tray, and conveys one by one to the document scanning unit 130. The document scanning unit 130 exposes an image of a document, which has been conveyed onto a platen glass 11 by the automatic document feeder 120, to an exposure lamp 13 attached to a slider 12 moving beneath the platen glass 11. A reflection light from the document is led by a mirror 14 and two reflection mirrors 15 and 15A to a projection lens 16, and is imaged on a CCD (Charge Coupled Device) sensor 18. The exposure lamp 13 and the mirror 14 are attached to the slider 12, and the slider 12 is moved by a scanner motor 17 in the direction of arrow as shown in the figure (in a sub scanning direction) at the speed V in accordance with a copy magnification rate. This allows scanning the entire surface of the document placed on the platen glass 11. Further, according to movement of the exposure lamp 13 and the mirror 14, two reflection mirrors 15 and 15A move in the direction of arrow as shown in the figure at the speed V/2. Consequently, an optical path length of the light emitted to the document by the exposure lamp 13 remains constant after reflecting from the document until being imaged on the CCD sensor 18.

The reflection light, which has been imaged on the CCD sensor 18, is converted into image data as an electrical signal within the CCD sensor 18, and is transmitted to a main circuit which is not shown in the figure. The main circuit performs an A/D conversion processing, a digital image processing and the like on the received analog image data, so as to output to the image forming unit 140. The main circuit converts the image data into data for print in cyan (C), magenta (M), yellow (Y) and black (K), so as to output to the image forming unit 140.

The image forming unit 140 includes developing devices 24Y, 24M, 24C and 24K, and their corresponding tonner bottles 41Y, 41M, 41C and 41K each being attachable to and detachable from the developing devices 24Y, 24M, 24C and 24K, respectively. Each of the tonner bottles 41Y, 41M, 41C and 41K stores toner of yellow, magenta, cyan and black, respectively. Here, "Y", "M", "C" and "K" respectively indicates yellow, magenta, cyan and black. Toners stored in the toner bottles 41Y, 41M, 41C and 41K are respectively supplied to each of the developing devices 24Y, 24M, 24C and 24K through the sub hopper which will be described later.

The image forming unit 140 includes image forming units 20Y, 20M, 20C and 20K, each of which is for yellow, magenta, cyan and black. When at least one of the image forming units 20Y, 20M, 20C and 20K is driven, an image is formed. All of the image forming units 20Y, 20M, 20C and 20K are driven, a full color image is formed. The data for print each in yellow, magenta, cyan and black is input to each of the image forming units 20Y, 20M, 20C and 20K. The image forming units 20Y, 20M, 20C and 20K are the same except for color of toner. Therefore, the image forming unit 20Y for forming an image in yellow will be described as an example hereinafter.

The image forming unit 20Y includes: an exposure head 21Y to which the data for print in yellow is input; a photoreceptor drum (an image carrying member) 23Y; an electrostatic charger 22Y; the developing device 24Y; and a transfer charger 25Y. The exposure head 21Y emits a laser light in response to reception of the data for print (electrical signal). The emitted laser light is one-dimensionally scanned by a polygon mirror included in the exposure head 21Y, so as to cause the photoreceptor drum 23Y to be exposed. The direction of one-dimensional scanning of the photoreceptor drum is a main scanning direction.

The photoreceptor drum 23Y, after being charged by the electrostatic charger 22Y, is irradiated with the laser light emitted by the exposure head 21Y. Thus, an electrostatic latent image is formed on the photoreceptor drum 23Y. Next, the developing device 24Y puts toner on the electrostatic latent image so that a toner image is formed. The toner image formed on the photoreceptor drum 23Y is transferred onto an intermediate transfer belt 30 by the transfer charger 25Y.

Meanwhile, the intermediate transfer belt 30 is suspended between a driving roller 33C and a roller 33A so as not to be loosened. When the driving roller 33C rotates counterclockwise as shown in the figure, the intermediate transfer belt 30 rotates counterclockwise as shown in the figure at a predetermined speed. In accordance with rotation of the intermediate transfer belt 30, the roller 33A rotates counterclockwise.

Accordingly, each of the image forming units 20Y, 20M, 20C and 20K consecutively transfers the toner image onto the intermediate transfer belt 30. The timing when each of the image forming units 20Y, 20M, 20C and 20K transfers the toner image onto the intermediate transfer belt 30 is controlled by an event that a reference mark attached to the intermediate transfer belt 30 is detected. Then, toner images each in yellow, magenta, cyan and black respectively are superimposed on the intermediate transfer belt 30.

Sheets of paper in different sizes are set in each of paper feed cassettes 35, 35A and 35B. A sheet of paper in a desired size is carried to a conveyance path by a paper feed rollers 36, 36A and 36B each attached to the paper feed cassettes 35, 35A and 35B respectively. The sheet of paper carried to the conveyance path is carried to a timing roller 31 by a conveyance roller pair 37.

A timing sensor for detecting the reference mark attached to the intermediate transfer belt 30 is provided. When the timing sensor detects the reference mark attached to the intermediate transfer belt 30, the timing roller 31 supplies a sheet of paper to the intermediate transfer belt 30 in synchronization with the detection. The sheet of paper is pressed on the intermediate transfer belt 30 by a transfer roller 26, and then the toner images each in yellow, magenta, cyan and black respectively, which have been formed in a superimposed manner on the intermediate transfer belt 30, are transferred onto the sheet of paper. A cleaner 28 is arranged on an outer circumferential side of the driving roller 33C. The cleaner 28 removes toner remaining on the intermediate transfer belt 30.

The sheet of paper on which the toner images have been transferred is carried to a fixing roller pair 32, and is heated by the fixing roller pair 32. This allows toner to be melted so as to be fixed to the sheet of paper. After that, the sheet of paper is ejected to a sheet ejection tray 39. Here, it will be described about the MFP 100 in tandem system which includes the image forming units 20Y, 20M, 20C and 20K each forming a toner image in different four colors on a sheet of paper, however, there may be an MFP in 4 cycle system which includes one photoreceptor drum to consecutively transfer each of toner images in different four colors onto a sheet of paper.

In the case of forming an image in full color, the MFP 100 drives all of the image forming units 20Y, 20M, 20C and 20K; whereas in the case of forming an image in monochrome, the MFP 100 drives any one of the image forming units 20Y, 20M, 20C and 20K. Further, the MFP 100 can form an image by combining two or more of the image forming units 20Y, 20M, 20C and 20K.

Figure 3:
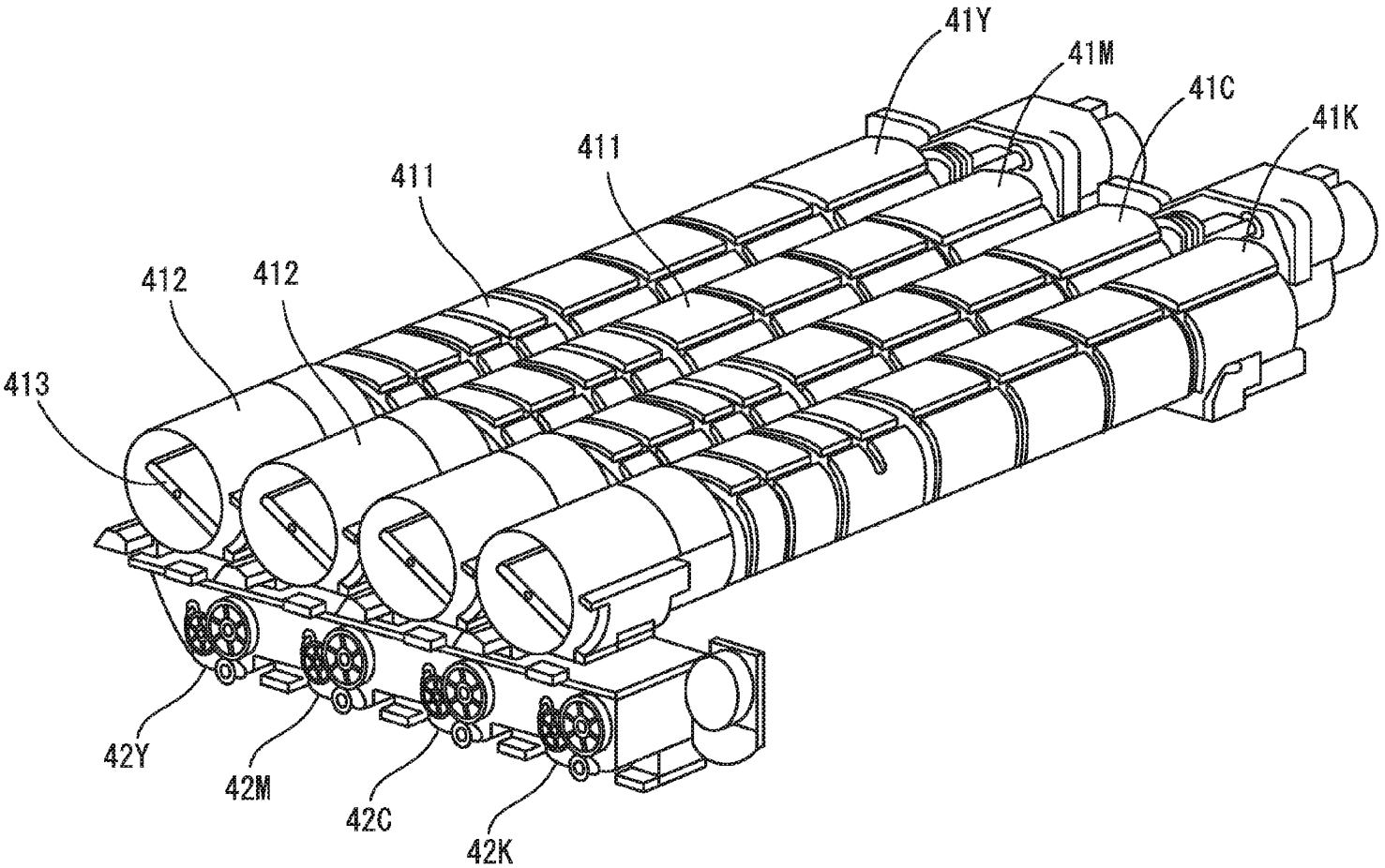
FIG. 3 is a perspective view showing external appearances of a toner bottle and a sub hopper.

FIG. 3 is a perspective view showing external appearances of a toner bottle and a sub hopper. Referring to FIG. 3, each of the toner bottles 41Y, 41M, 41C and 41K includes a bottle portion 411 for storing toner, and a cap portion 412 attached to one end of the bottle portion 411. The cap portion 412 is provided with a knob 413. In a state where the toner bottles 41Y, 41M, 41C and 41K are inserted into the MFP 100, the knob 413 is rotated by a predetermined angle, so that the cap portion 412 is fixed to the MFP 100. Sub hoppers 42Y, 42M, 42C and 42K are integrally provided, each of which corresponds to each of the toner bottles 41Y, 41M, 41C and 41K. In a state where the toner bottles 41Y, 41M, 41C and 41K are inserted into the MFP 100, the cap portion 412 of each of the toner bottles 41Y, 41M, 41C and 41K is arranged above each of the sub hoppers 42Y, 42M, 42C and 42K.

Configurations of the sub hoppers 42Y, 42M, 42C and 42K are almost the same, and configurations of the developing devices 24Y, 24M, 24C and 24K are almost the same. Therefore, internal configurations of the toner bottle 41Y, the sub hopper 42Y and the developing device 24Y will be described here as an example.

Figure 4:
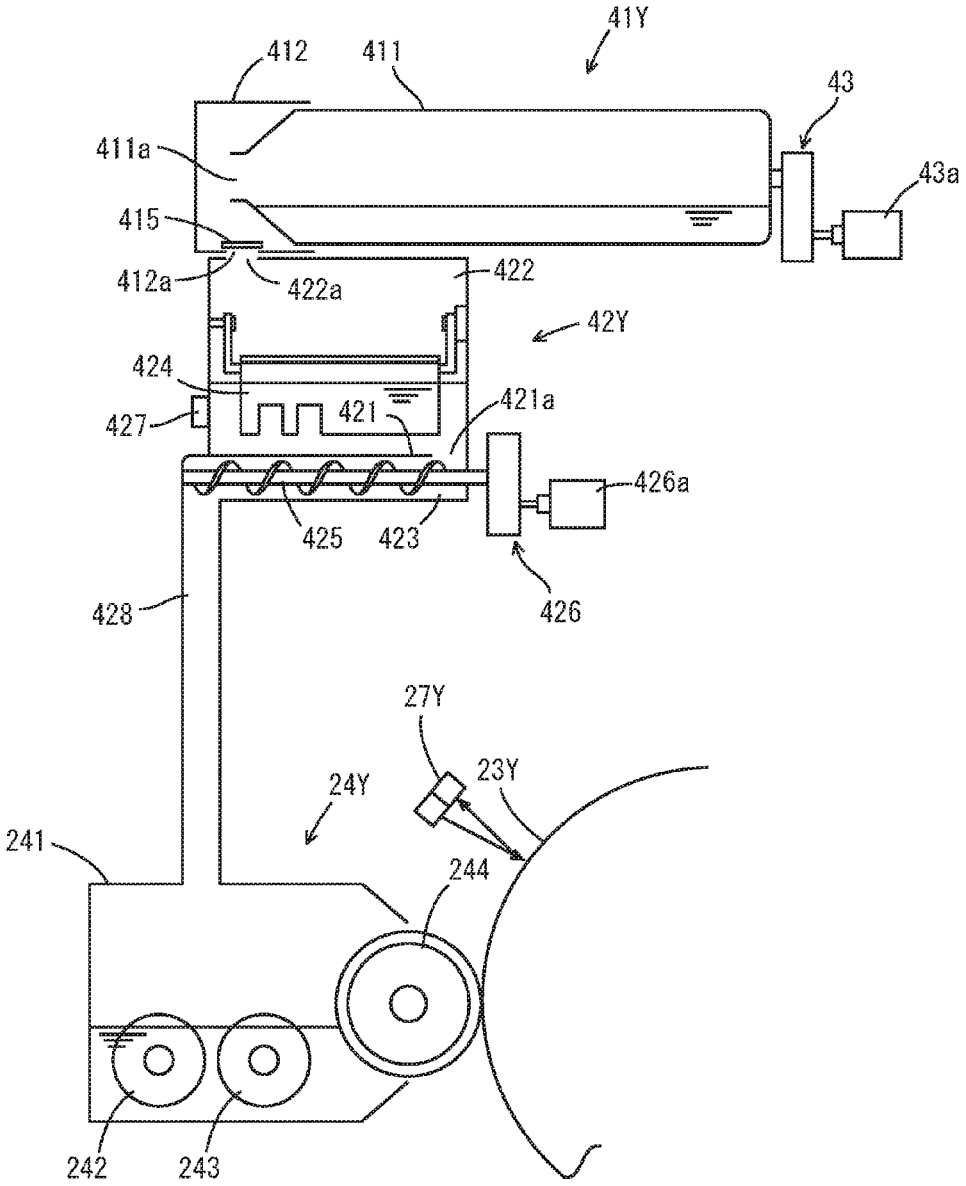
FIG. 4 is a diagram showing internal configurations of a tonner bottle, a sub hopper and a developing device.

FIG. 4 is a diagram showing internal configurations of a tonner bottle, a sub hopper and a developing device. Referring to FIG. 4, an opening 411*a* is provided at one end of the bottle portion 411, and a helical protrusion is formed on an inner circumferential surface of the bottle portion 411. The cap portion 412 is attached to the bottle portion 411 so as to cover a surrounding surface of the opening 411*a*. A supply port 412*a*, which is opened downward, is provided to the cap portion 412, and a shutter portion 415 is provided to make the supply port 412*a* openable/closable. The shutter portion 415 is interlocked with the knob 413 (FIG. 3), so that the shutter portion 415 is released in response to an event that the knob 413 is rotated. A bottle rotating member 43 is connected to the other end of the bottle portion 411. The bottle rotating member 43 includes a stepping motor 43*a*, and rotating force of the stepping motor 43*a* is transmitted to the toner bottle 41Y, so that the toner bottle 41Y is rotated.

A supply port 422*a* is provided on an upper part of the sub hopper 42Y so as to overlap the supply port 412*a* of the toner bottle 41Y. The inside of the sub hopper 42Y is divided into a housing portion 422 and a conveyance portion 423 by a partition 421. A gap 421*a* is formed between one end of the partition 421 and an inner wall surface of the sub hopper 42Y. The gap 421*a* is positioned above one end of the conveyance portion 423, so that the housing portion 422 communicates with the conveyance portion 423 through the gap 421*a*.

When the toner bottle 41Y is rotated by the bottle rotating member 43 toner in the bottle portion 411 moves forward along the helical protrusion formed on an inner circumferential surface of the bottle portion 411, and flows out through the opening 411*a*. Then, toner flowing out through the opening 411*a* moves through the supply port 412*a* of the cap portion 412 as well as through the supply port 422*a* of the sub hopper 42Y, and falls down into the housing portion 422 of the sub hopper 42Y.

The housing portion 422 is provided with a floating member 424 which swings around a horizontal axis. Inclination of the floating member 424 changes in accordance with an amount of toner inside the housing portion 422. An empty sensor 427 is provided on an outer surface of the housing portion 422. When the inclination of the floating member 424 becomes large due to a shortage of the amount of toner in the housing portion 422, the empty sensor 427 detects a detected object (a magnet, for example) attached to the floating member 424.

The conveyance portion 423 is provided with a supply roller 425 having a helical screw around a shaft. The supply roller 425 is connected to a sub hopper driving member 426. The sub hopper driving member 426 includes a stepping motor 426*a*, and rotating force of the stepping motor 426*a* is transmitted to the supply roller 425, so that the supply roller 425 is rotated. The other end of the conveyance portion 423 (the opposite end to the gap 421*a*) is connected to the developing device 24Y through a conveyance portion 428. When the supply roller 425 is rotated by the sub hopper driving member 426, toner is conveyed from one end to the other end of the conveyance portion 423, so as to be supplied to the developing device 24Y through the conveyance portion 428. This allows controlling an amount of toner to be supplied to the developing device 24Y according to the number of rotations of the supply roller 425. Further, in the case where a state of toner stored in the housing portion 422 is normal, a relationship between the number of rotations of the supply roller 425 and the amount of toner supplied to the developing device 24Y is proportional. The state of toner stored in the housing portion 422 includes the amount of toner stored in the housing portion 422 and liquidity of toner stored in the housing portion 422. Therefore, it is possible to determine as a standard driving amount the number of rotations of the supply roller 425 for supplying a unit amount of toner to the developing device 24Y by measuring, after normalizing the state of toner stored in the housing portion 422, the number of rotations of the supply roller 425 and the amount of toner supplied to the developing device 24Y.

The developing device 24Y includes a storage 241, a conveyance rollers 242 and 243, and a developing roller 244. Toner supplied from the sub hopper 42Y is stored in the storage 241. The conveyance rollers 242 and 243 are arranged inside the storage 241, and the developing roller 244 is arranged in a manner as to be partially exposed from the storage 241. The conveyance rollers 242 and 243 are rotated by a motor which is not shown in the figure, so as to convey toner in the storage 241 to the developing roller 244. An outer circumferential surface of of the developing roller 244 is arranged to face an outer circumferential surface of the photoreceptor drum 23Y. Carrier is stored in the storage 241. The carrier possesses magnetism, but the toner does not possess magnetism. During a period which the toner and carrier are conveyed by the conveyance rollers 242 and 243, the toner is adhered to the carrier by static electricity. The developing roller 244 includes a magnet which is fixedly arranged inside a rotatable sleeve. When being rotated by a motor which is not shown in the figure, the developing roller 244 conveys, while supporting by the magnetic force, the carrier with the toner adhering thereto, so as to transfer the toner onto the electrostatic latent image formed on the photoreceptor drum 23Y. Here, toner density means a ratio of toner to the toner and carrier stored in the storage 241.

Bias voltage which is applied to the developing roller 244 is determined based on the assumption that toner density is within a predetermined range. Therefore, if the toner density falls out of the predetermined range, printing quality becomes unstable. For example, there may be a case of occurrence of a phenomenon called fogging where the toner is adhered to a part other than the electrostatic latent image formed on the photoreceptor drum 23Y, and a case of occurrence of a phenomenon called carrier adhesion where the carrier is adhered to the photoreceptor drum 23Y. If the carrier adhesion occurs, the photoreceptor drum 23Y and the like can be damaged, which will shorten the life of parts, and possibly cause the main body of the MFP to break down. Therefore, it is necessary to maintain toner density in the storage 241 within the predetermined range.

A density detecting sensor 27Y is arranged in a lower stream of the developing roller 244 of the photoreceptor drum 23Y. The density detecting sensor 27Y includes a light emitting diode and a phototransistor, and is arranged so as to face a surface of the photoreceptor drum 23Y. The density detecting sensor 27Y receives by the phototransistor a light reflected by the photoreceptor drum 23Y after being emitted from the light emitting diode, and outputs an electrical signal which is photoelectrically converted by the phototransistor for output. The electrical signal being output by the density detecting sensor 27Y is different according to an amount of toner adhered to the photoreceptor drum 23Y, and this allows detecting from the electrical signal the amount of toner adhered to the photoreceptor drum 23Y. It should be noted that, the amount of toner adhered to the photoreceptor drum 23Y is measured in the present embodiment, however, an amount of toner adhered to the intermediate transfer belt 30 may be measured. In the case where the amount of toner adhered to the intermediate transfer belt 30 is measured, a single density detecting sensor is sufficient to be provided for the image forming units 20Y, 20M, 20C and 20K.

Figure 5:
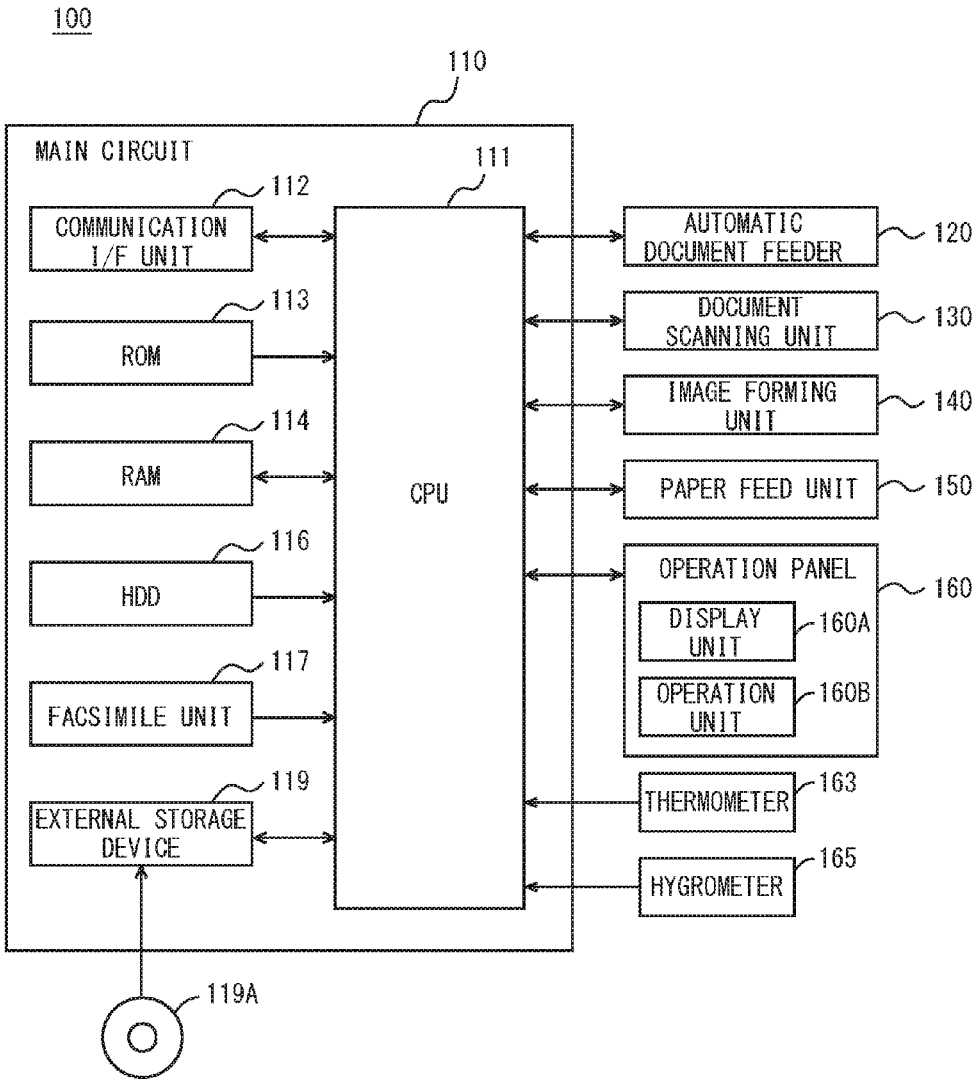
FIG. 5 is a block diagram showing an example of a hardware configuration of the MFP.

FIG. 5 is a block diagram showing an example of a hardware configuration of the MFP. Referring to FIG. 5, a main circuit 110 included in the MFP 100 includes: a CPU 111; a communication interface (I/F) unit 112; a ROM 113; a RAM 114; a hard disk drive (HDD) 116 as a mass storage; a facsimile unit 117; and an external storage device 119 on which a compact disk ROM (CD-ROM) 119A is mounted. Further, the CPU 111 is connected to each of an automatic document feeder 120, a document scanning unit 130, an image forming unit 140, a paper feed unit 150 and an operation panel 160, and is responsible for overall control of the MFP 100.

The ROM 113 stores a program executed by the CPU 111 and data necessary for execution of the program. The RAM 114 is used as a work area for the CPU 111 to execute the program.

The operation panel 160 is arranged on an upper part of the MFP 100 (as shown in FIG. 1), and includes a display unit 160A and an operation unit 160B. The display unit 160A is a display device such as Liquid Crystal Display (LCD) device or an organic ELD (Electroluminescence Display) device, for example, and displays instruction menus to users, information about acquired image data. The operation unit 160B includes a plurality of keys, and accepts input of data, such as instructions, characters, and numerical characters, according to the key operations by the user. The operation unit 160B further includes a touch panel disposed on the display unit 160A.

The communication I/F unit 112 is an interface for connecting the MFP 100 to a network. The CPU 111 communicates with MFPs 101, 102, and a PC 200 for transmission/reception of data through the communication I/F unit 112. Further, the communication I/F unit 112 is capable of communicating with a computer which is connected to the Internet through a network.

The facsimile unit 117 is connected to the public switched telephone networks (PSTN) and transmits facsimile data to or receives facsimile data from the PSTN. The facsimile unit 117 stores the received facsimile data in the HDD 116, or outputs to the image forming unit 140. The image forming unit 140 prints on a sheet of paper the facsimile data received from the facsimile unit 117. Further, the facsimile unit 117 converts the data stored in the HDD 116 into facsimile data so as to transmit to a facsimile device which is connected to the PSTN.

The CD-ROM 119A is mounted on the external storage device 119. The CPU 111 is accessible to the CD-ROM through the external storage device 119. The CPU 111 loads into the RAM 114 for execution a program stored in the CD-ROM 119A mounted on the external storage device 119. It should be noted that, a program executed by the CPU 111 is not limited to a program stored in the CD-ROM 119A, but a program stored in the HDD 116 may be loaded into the RAM 114 for execution. In this case, another computer connected to the network may overwrite the program stored in the HDD 116 of the MFP 100 or additionally write a new program therein. Alternatively, the MFP 100 may download a program from another computer connected to the network and store the program into the HDD 116. The program referred to here includes not only a program directly executable by the CPU 111 but also a source program, a compressed program, and an encrypted program.

It is noted that the medium for storing the program executed by the CPU 111 is not restricted to the CD-ROM 119A. It may be an optical disc (a magneto-optical (MO) disc/a mini disc (MD)/a digital versatile disc (DVD)), an IC card, an optical card, or a semiconductor memory such as a mask ROM, an erasable programmable ROM (EPROM), an electrically erasable and programmable ROM (EEPROM), or the like.

Figure 6:
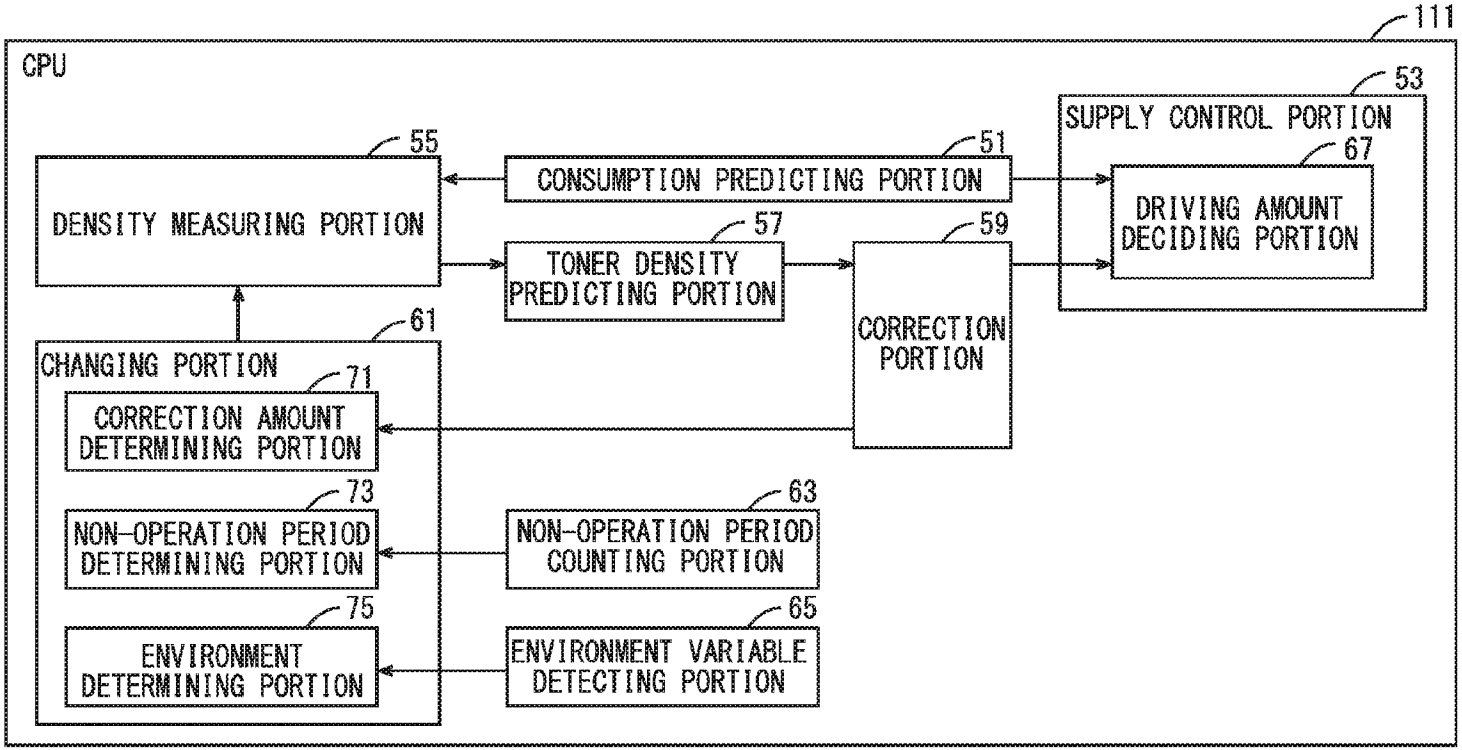
FIG. 6 is a block diagram showing an example of functions of a CPU included in the MFP.

FIG. 6 is a block diagram showing an example of functions of a CPU included in the MFP. The functions shown in FIG. 6 are functions formed in the CPU 111 as the CPU 111 included in the MFP 100 executes a toner supply program stored in the CD-ROM 119A. Referring to FIG. 6, the CPU 111 included in the MFP 100 includes: a consumption predicting portion 51; a supply control portion 53; a density measuring portion 55; a toner density predicting portion 57; a correction portion 59; a changing portion 61; a non-operation period counting portion 63; and an environment variable detecting portion 65.

The consumption predicting portion 51 predicts toner consumption based on image data targeted for image forming. As mentioned earlier, the data for print in cyan is output to the image forming unit 20C, the data for print in magenta is output to the image forming unit 20M, the data for print in yellow is output to the image forming unit 20Y, and the data for print in black is output to the image forming unit 20K. Each of the image forming units 20Y, 20M, 20C and 20K forms an image on a sheet of paper based on the data for print corresponding thereto. For example, the image forming unit 20Y forms, based on the data for print in yellow, an image with toner stored in the storage 241 on a sheet of paper supplied from the paper feed unit 150.

Therefore, the consumption predicting portion 51 converts the image data in RGB color into the data for print in each of cyan (C), magenta (M), yellow (Y) and black (K). Then, based on the data for print in each of cyan, magenta, yellow and black, the consumption predicting portion 51 predicts an amount of toner (hereinafter, referred to as "toner consumption") of each of cyan, magenta, yellow and black, all of which are consumed by the image forming unit 140. The consumption predicting portion 51 outputs to the supply control portion 53 and the density measuring portion 55 the toner consumption of each of cyan, magenta, yellow and black. Each of the image forming units 20Y, 20M, 20C and 20K are controlled by the CPU 111 in the same manner as each other except that the data for print is different. Therefore, it will be described as an example that the image forming unit 20 Y is controlled by the CPU 111 in the following description, unless otherwise specified.

The consumption predicting portion 51 predicts, based on the data for print in yellow, toner consumption of yellow which is consumed by the image forming unit 20Y, and outputs the predicted toner consumption to the supply control portion 53, the density measuring portion 55 and the toner density predicting portion 57. The consumption predicting portion 51 calculates the toner consumption from a pixel value of the data for print in yellow. A toner amount measured in advance may be assigned to each of a plurality of pixel values, and the toner consumption may be calculated from the pixel value of the data for print. Further, a calculation formula defining a relationship between the pixel value and the toner amount may be prepared in advance.

The supply control portion 53 controls to cause the sub hopper driving member 426 to supply toner stored in the housing portion 422 of the sub hopper 42Y to the developing device 24Y. Specifically, the supply control portion 53 controls the stepping motor 426*a* so as to control an amount of toner to be supplied from the housing portion 422 of the sub hopper 42Y to the developing device 24Y.

The supply control portion 53 includes a driving amount deciding portion 67. The driving amount deciding portion 67 decides, based on the toner consumption being input from the consumption predicting portion 51, a driving amount of the sub hopper driving member 426. Specifically, in order that the same amount of toner as the toner consumption is supplied from the sub hopper 42Y to the developing device 24Y, the supply control portion 53 decides the number of rotations of the stepping motor 426*a* based on the toner consumption and the standard driving amount. The driving amount deciding portion 67 decides a driving amount each time when a total of the toner consumption being input from the consumption predicting portion 51 becomes equal to or more than an upper limit value for supplying. The upper limit value for supplying is a predetermined value. The driving amount deciding portion 67 decides a driving amount in the case where a total of the toner consumption being input from the consumption predicting portion 51 becomes equal to or more than an upper limit value for supplying after the driving amount is decided. It should be noted that the driving amount deciding portion 67 may decide the driving amount each time when the toner consumption is input from the consumption predicting portion 51.

The density measuring portion 55 controls the image forming unit 20Y and the density detecting sensor 27Y so as to cause the image forming unit 20Y to form on the photoreceptor drum 23Y a toner image having a predetermined image pattern (hereinafter, referred to as a "patch image"), and measures density of the patch image based on the electrical signal being output by the density detecting sensor 27Y. The image pattern is not limited to a particular type, but it may be an image having a predetermined density. The size and shape of the patch image are not limited, but it is here assumed that the patch image has a rectangular shape with height 20 mm and width 40 mm. The patch image formed on the photoreceptor drum 23Y is deleted from the photoreceptor drum 23Y after being measured by the density detecting sensor 27Y. Meanwhile, the patch image may be formed on the photoreceptor drum 23Y by changing the bias voltage applied to the developing roller 244, and then density of the patch image may be measured from an inclination of the electrical signal being output by the density detecting sensor 27Y measuring the patch image.

The density measuring portion 55 measures density of the patch image each time when a total of the toner consumption being input from the consumption predicting portion 51 becomes equal to or more than a first threshold value. In the case where a total of the toner consumption being input from the consumption predicting portion 51 after density of the patch image has been measured becomes equal to or more than the first threshold value, the density measuring portion 55 measures density of the patch image, and outputs the measured density of the patch image to the toner density predicting portion 57. It is preferable that the first threshold value is greater than the upper limit value for supplying. Since toner is consumed by an event that the patch image is formed on the photoreceptor drum 23Y, it is necessary to minimize the toner amount which is consumed by an event that the density measuring portion 55 measures density of the patch image.

The toner density predicting portion 57 predicts toner density in the storage 241 based on the density of the patch image. Since density of the image pattern is determined in advance, if the toner density in the storage 241 is within a predetermined range, the density of the patch image should have a predetermined value. It is preferable to prepare in advance a table which defines a relationship between the density of the patch image and the toner density in the storage 241, after conducting an experiment where the density of the patch image and the toner density in the storage 241 are measured per event of changing the toner density in the storage 241. The toner density predicting portion 57 refers to the table, and determines, as a predicted value of the toner density in the storage 241, the toner density which corresponds to the density of the patch image being input from the density measuring portion 55. The toner density predicting portion 57 outputs the predicted toner density to the correction portion 59.

In response to an event that the toner density is input from the toner density predicting portion 57, the correction portion 59 corrects the standard driving amount based on the toner density. If the standard driving amount has been corrected, the correction portion 59 corrects the latest standard driving amount after correction. In the case where a correction amount of the standard driving amount becomes equal to or more than a second threshold value, the correction portion 59 outputs a first change instruction to the changing portion 61. The correction amount of the standard driving amount is a difference between the standard driving amount after correction and a default of the standard driving amount. Therefore, the correction portion 59 may output the first change instruction to the changing portion 61 in the case where the standard driving amount after correction becomes equal to or more than a predetermined value.

The standard driving amount is the number of rotations of the supply roller 425 for supplying a toner amount per unit to the developing device 24Y. The correction portion 59 corrects the standard driving amount to a greater value in the case where the toner density is lower than a range of toner density which is predetermined for the storage 241. For example, the correction portion 59 corrects the standard driving amount to a value increased at a predetermined ratio. The correction portion 59 outputs the standard driving amount after correction to the driving amount deciding portion 67 and the changing portion 61.

The correction portion 59 corrects the standard driving amount to a smaller value in the case where the toner density is higher than the range of toner density which is predetermined for the storage 241. For example, the correction portion 59 corrects the standard driving amount to a value reduced at a predetermined ratio. Further, in the case where the toner density is within the range of toner density which is predetermined for the storage 241, the correction portion 59 does not correct the standard driving amount.

The non-operation period counting portion 63 counts, as a non-operation period, a period during which each of the image forming units 20Y, 20M, 20C and 20K is not driven. For example, the non-operation period during which the image forming unit 20Y is not driven is a period during which the image forming unit 20Y is not driven, and includes a period during which at least any one of the image forming units 20C, 20M and 20K is driven. The non-operation period counting portion 63 outputs a second change instruction to the changing portion 61 in the case where the non-operation period of any one of the image forming units 20Y, 20M, 20C and 20K becomes equal to or more than a predetermined period. The second change instruction includes unit identification information for identifying a unit among the image forming units 20Y, 20M, 20C and 20K, of which the non-operation period becomes equal to or more than the predetermined period. For example, in the case where the non-operation period of the image forming unit 20Y becomes equal to or more than the predetermined period, the second change instruction includes the unit identification information of the image forming unit 20Y.

The environment variable detecting portion 65 outputs a third change instruction to the changing portion 61 in the case where an environmental change within a predetermined time satisfies a predetermined condition. The environment variable detecting portion 65 acquires a temperature measured by a thermometer 163 and a humidity measured by a hygrometer 165. In the case where a difference of the temperature within a predetermined time is equal to or more than a predetermined threshold value, and/or in the case where a difference of the humidity within a predetermined time is equal to or more than a predetermined threshold value, the environment variable detecting portion 65 determines that the predetermined condition is satisfied, and outputs the third change instruction.

The changing portion 61 changes a timing when the density measuring portion 55 measures density of the patch image. The changing portion 61 includes a correction amount determining portion 71, a non-operation period determining portion 73, and an environment determining portion 75. The correction amount determining portion 71 changes, in response to an event that the first change instruction is input from the correction portion 59, the timing when the density measuring portion 55 measures the density of the patch image. The non-operation period determining portion 73 changes, in response to an event that the second change instruction is input from the non-operation period counting portion 63, the timing when the density measuring portion 55 measures the density of the patch image. The environment determining portion 75 changes, in response to an event that the third change instruction is input from the environment variable detecting portion 65, the timing when the density measuring portion 55 measures the density of the patch image.

The timing when the density measuring portion 55 measures the density of the patch image is a time when a total of the toner consumption being input from the consumption predicting portion 51 after the density of the patch image has been measured becomes equal to or more than the first threshold value. For example, the changing portion 61 changes the first threshold value to a value reduced at a predetermined ratio. The changing portion 61 changes the first threshold value to a smaller value, and outputs the second threshold value after change to the density measuring portion 55. In the case where the first threshold value has been changed, the changing portion 61 changes the latest first threshold value after change to a smaller value. Further, in the case where the first threshold value after change becomes equal to or less than the upper limit value for supplying, the changing portion 61 may cause the image forming unit 20Y not to be driven.

After the second threshold value after change is input from the changing portion 61, in the case where a total of the toner consumption being input from the consumption predicting portion 51 after the density of the patch image has been measured becomes equal to or more than the first threshold value, the density measuring portion 55 measures density of the patch image, and outputs the measured density of the patch image to the toner density predicting portion 57.

Figure 7:
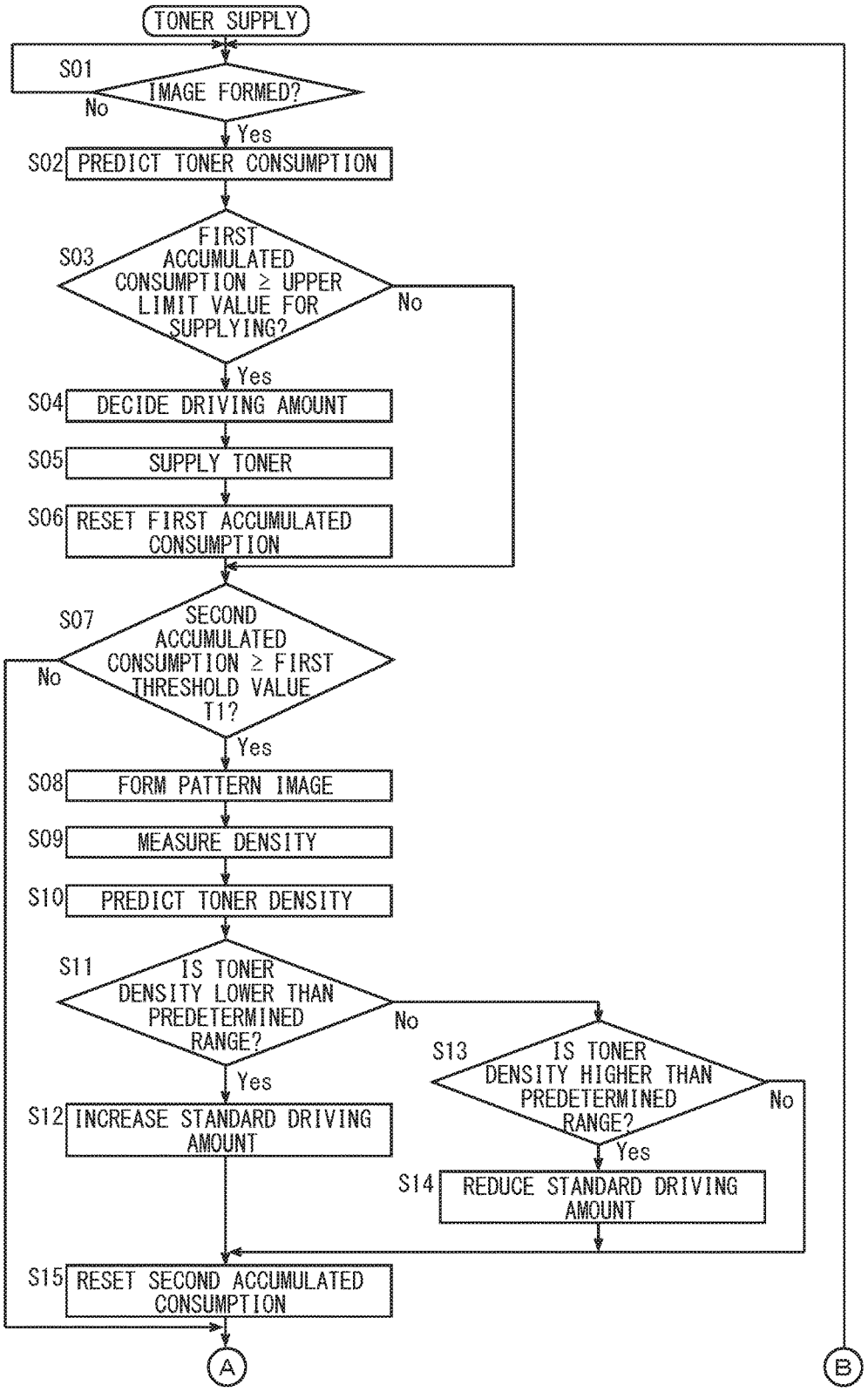
FIG. 7 is a first flowchart illustrating an example of a flow of a toner supply processing.
Figure 8:
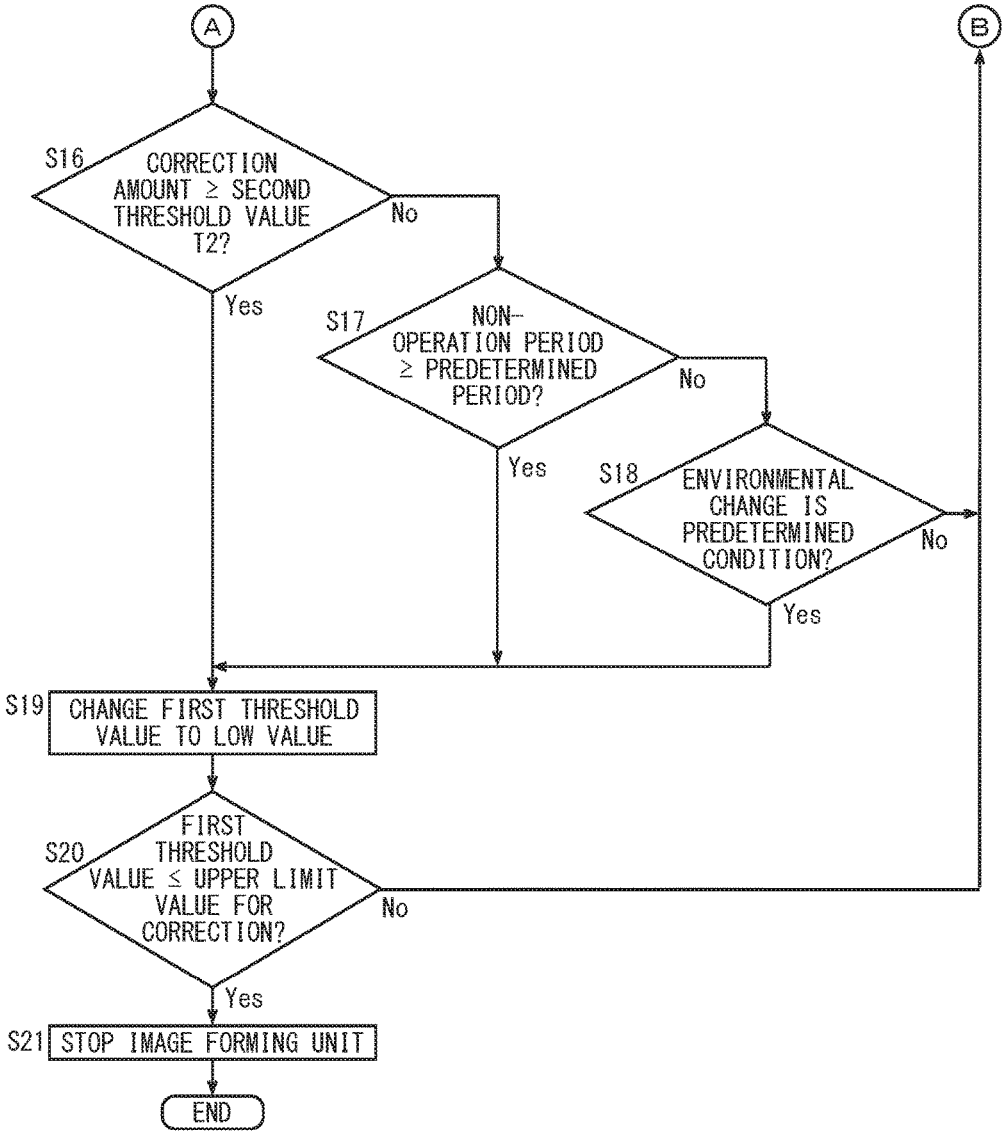
FIG. 8 is a second flowchart illustrating an example of a flow of a toner supply processing.

FIGS. 7 and 8 are flowcharts illustrating an example of a flow of a toner supply processing. The toner supply processing is a processing executed by the CPU 111 as the CPU 111 included in the MFP 100 executes a toner supply program stored in the CD-ROM 119A. Referring to FIGS. 7 and 8, the CPU 111 determines whether or not an image forming processing has been executed (step S01). If the image forming processing has been executed (YES in step S01), the process proceeds to step S02.

In step S02, the CPU 111 predicts the toner consumption in the image forming processing. Based on the data for print in each of yellow, cyan, magenta and black converted from the image data targeted for image forming, the CPU 111 predicts the toner consumption of each of yellow, cyan, magenta and black. The processing after step S02 is executed for each toner of yellow, cyan, magenta and black, and the same processing is executed for each toner of yellow, cyan, magenta and black. Therefore, the toner supply processing executed for toner of yellow will be described as an example hereinafter.

In the following step S03, the CPU 111 determines whether or not a first accumulated consumption is equal to or more than the upper limit value for supplying. The first accumulated consumption is a value of accumulation of toner consumption predicted in step S02, which is initially set to zero and reset to zero in step S06 which will be described later. If the first accumulated consumption is equal to or more than the upper limit value for supplying, the process proceeds to step S04; otherwise, the process proceeds to step S07.

In step S04, the CPU 111 decides the driving amount. Based on the first accumulated consumption and the standard driving amount, the CPU 111 decides the driving amount. The standard driving amount is changed in step S12 or step S14, which will be described later. Therefore, in the case where the standard driving amount has been changed in step S12 or step S14, the CPU 111 decides the driving amount based on the standard driving amount after change and the first accumulated consumption. In the following step S05, the CPU 111 supplies toner to the developing device 24Y, and the process proceeds to step S06. Specifically, the CPU 111 rotates the supply roller 425 by rotating the stepping motor 426*a* the same times as the number of rotations defined by the driving amount which has been decided in step S04, so as to supply toner to the developing device 24Y. In step S06, the CPU 111 resets the first accumulated consumption, and the process proceeds to step S07.

In step S07, the CPU 111 determines whether or not a second accumulated consumption is equal to or more than a first threshold value T1. The second accumulated consumption is a value of accumulation of toner consumption predicted in step S02, which is initially set to zero and reset to zero in step S15 which will be described later. If the second accumulated consumption is equal to or more than the first threshold value T1, the process proceeds to step S08; otherwise, the process proceeds to step S16.

In step S08, the CPU 111 forms a pattern image. The CPU 111 controls to cause the image forming unit 20Y to form a patch image on the photoreceptor drum 23Y. Then, the CPU 111 uses the density detecting sensor 27Y so as to measure density of the patch image (step S09). Based on the electrical signal that the density detecting sensor 27Y outputs in response to reception of a light reflected from the patch image, the CPU 111 measures the density of the patch image. In the following step S10, the CPU 111 predicts toner density in the storage 241 based on the density of the patch image measured in step S09.

In the following step S11, the CPU 111 determines whether or not the toner density predicted in step S10 is lower than a predetermined range. If the toner density is lower than the predetermined range, the process proceeds to step S12; otherwise, the process proceeds to step S13. In step S12, the CPU 111 increases the standard driving amount, and the process proceeds to step S15. For example, the CPU 111 increases the standard driving amount at a predetermined ratio. Meanwhile, in step S13, the CPU 111 determines whether or not the toner density predicted in step S10 is higher than a predetermined range. If the toner density is higher than the predetermined range, the process proceeds to step S14; otherwise, the process proceeds to step S15. In step S14, the CPU 111 reduces the standard driving amount, and the process proceeds to step S15. For example, the CPU 111 reduces the standard driving amount at a predetermined ratio. In step S15, the CPU 111 resets the second accumulated consumption, and the process proceeds to step S16.

In step S16, the CPU 111 determines whether or not the correction amount of the standard driving amount is equal to or more than a second threshold value T2. The correction amount means a difference between the standard driving amount after being increased in step S12 or reduced in step S14 and the default of the standard driving amount. If the correction amount is equal to or more than the second threshold value T2, the process proceeds to step S19; otherwise, the process proceeds to step S17.

In step S17, the CPU 111 determines whether or not the non-operation period is equal to or more than a predetermined period. The non-operation period during which the image forming unit 20Y for yellow is not driven is equal to or more than the predetermined period, the process proceeds to step S19; otherwise, the process proceeds to step S18. In step S18, the CPU 111 determines whether or not an environmental change satisfies a predetermined condition. For example, in the case where the temperature is defined as an environment variable, the predetermined condition is a case where a difference of the temperature within a predetermined time is equal to or more than a predetermined threshold value. In the case where the humidity is defined as an environment variable, the predetermined condition is a case where a difference of the humidity within a predetermined time is equal to or more than a predetermined threshold value. Further, the environment variable may be both the temperature and the humidity. In this case, the predetermined condition is a case where a difference of the temperature within a predetermined time is equal to or more than a predetermined threshold value, as well as a difference of the humidity within a predetermined time is equal to or more than a predetermined threshold value. If the environmental change satisfies the predetermined condition, the process proceeds to step S19; otherwise, the process returns to step S01.

In step S19, the CPU 111 changes the first threshold value to a smaller value, and the process proceeds to step S20. For example, the CPU changes the first threshold value to a value at a predetermined ratio. In the following step S20, the CPU 111 determines whether or not the first threshold value after change is equal to or less than an upper limit value for correction. If the first threshold value after change is equal to or less than the upper limit value for correction, the process proceeds to step S21; otherwise, the process returns to step S01. In step S21, the CPU 111 stops the image forming unit 20Y, and the process ends. In the case where the first threshold value after change is equal to or less than the upper limit value for correction, there is a possibility of failure if the image forming processing is continued because the toner density in the developing device 24Y of the image forming unit 20Y is low.

<Example of Embodiment>

Hereinafter, a result will be described where an image is continuously formed using image data for test at a printing rate of 10% until toner in the toner bottle 41Y runs out in both cases of changing and not changing an interval of detecting density of the patch image by the density detecting sensor 27Y. The first threshold value is set to 3 g. In this case, if the interval of detecting density of the patch image is not changed, the patch image is formed by using the image data for test per 100 sheets of paper on each of which the image is formed.

Further, the first threshold value is changed to one-fourth if the interval of detecting density of the patch image is changed. In this case, the patch image is formed by using the image data for test per 25 sheets of paper on each of which the image is formed.

As to image evaluation, an amount of toner fogging and an amount of carrier adhesion on a sheet of paper are visually evaluated. A result of the evaluation is shown by ranking in a range of 1 to 3 according to a degree. Rank 1 means poor quality; Rank 2 means that toner fogging and carrier adhesion are found but less in amount than a predetermined number, so that it cannot be defined as poor quality; and Rank 3 means that no toner fogging and no carrier adhesion are found.

<Change according to Correction Amount of Standard Driving Amount>

Here, the second threshold value is set as four times large as a default of the standard driving amount. In this case, if the standard driving amount after change becomes five times larger than the default of the standard driving amount, the first threshold value is changed to one-fourth.

FIG. 9 is a first diagram showing an experiment result. The experiment results in both cases of changing and not changing the interval of detecting density of the patch image are shown here. When a remaining amount of toner in the toner bottle 41Y becomes small, a difference occurs between the cases of changing and not changing the interval of detecting density of the patch image. In the case of not changing the interval of detecting density of the patch image, carrier adhesion becomes Rank 1 and poor quality of image is found. This is because the remaining amount of toner in the sub hopper 42Y of the image forming unit 20Y becomes small, and then the amount of toner supplied from the sub hopper 42Y to the storage 241 of the developing device 24Y becomes small, which causes change in the toner density in the storage 241. When the amount of toner supplied from the sub hopper 42Y to the storage 241 of the developing device 24Y, the standard driving amount is corrected to a larger value, however, in the case where the interval of correcting the standard driving amount remains constant, it takes time for the amount of toner supplied from the sub hopper 42Y to the storage 241 of the developing device 24Y to become an appropriate value. Therefore, this causes the toner density in the storage 241 to become constantly lower than a predetermined range.

In the case of changing the interval of detecting density of the patch image, toner fogging and carrier adhesion do not occur though the remaining amount of toner in the toner bottle 41Y becomes small. In the case where the remaining amount of toner in the sub hopper 42Y of the image forming unit 20Y becomes small, and then the amount of toner supplied from the sub hopper 42Y to the storage 241 of the developing device 24Y becomes small, the standard driving amount is corrected to a larger value. If the standard driving amount after change becomes five times larger than the default of the standard driving amount, the interval of detecting density of the patch image is changed to one-fourth. Therefore, a frequency of changing the standard driving amount becomes four times larger, and it is possible to quickly change the toner amount supplied from the sub hopper 42Y to the storage 241 of the developing device 24Y to an appropriate value. Further, this allows maintaining the toner density in the storage 241 in a predetermined range.

<Change according to Environmental Change>

Here, an image is formed in the MFP 100 arranged in an environment which is switched every one hour between a high-temperature and high-humidity (30 degrees and 70%) environment and a low-temperature and low-humidity (10 degrees and 30%) environment. The high-temperature and high-humidity environment has a temperature of 30 degrees Celsius and a humidity of 70%; the low-temperature and low-humidity environment has a temperature of 10 degrees Celsius and a humidity of 30%. If the interval of detecting density of the patch image is changed, in the case where the high-temperature and high-humidity environment is switched to the low-temperature and low-humidity environment or in the case where the low-temperature and low-humidity environment is switched to the high-temperature and high-humidity environment, the first threshold value is changed to one-fourth.

FIG. 10 is a second diagram showing an experiment result. The experiment results in both cases of changing and not changing the interval of detecting density of the patch image are shown here. A difference occurs between the cases of changing and not changing the interval of detecting density of the patch image.

In the case of not changing the interval of detecting density of the patch image, both toner fogging and carrier adhesion become Rank 1 and poor quality of image is found. This is because liquidity of toner is changed due to the environmental change, and then an amount of toner corresponding to the standard driving amount is stopped to be supplied from the sub hopper 42Y to the storage 241 of the developing device 24Y.

In the case of changing the interval of detecting density of the patch image, the interval of detecting density of the patch image is changed to one-fourth. Therefore, the frequency of changing the standard driving amount becomes four times larger, and this allows the toner amount supplied from the sub hopper 42Y to the storage 241 of the developing device 24Y to remain as an appropriate value.

<Change according to Non-Operation Period>

Here, a cycle is repeated where after an image is continuously formed on one thousand sheets of paper, the MFP 100 is left standing still for ten hours. A non-operation period during which the stepping motor 43*a* is not continuously driven is detected, and if the non-operation period becomes greater than a three-hour, the first threshold value is changed to one-fourth.

FIG. 11 is a third diagram showing an experiment result. The experiment results in both cases of changing and not changing the interval of detecting density of the patch image are shown here. A difference occurs between the cases of changing and not changing the interval of detecting density of the patch image.

In the case of not changing the interval of detecting density of the patch image, carrier adhesion becomes Rank 1 and poor quality of image is found. This is because liquidity of toner is changed due to the environmental change, and then the amount of toner corresponding to the standard driving amount is stopped to be supplied from the sub hopper 42Y to the storage 241 of the developing device 24Y.

In the case of changing the interval of detecting density of the patch image, the interval of detecting density of the patch image is changed to one-fourth. Therefore, the frequency of changing the standard driving amount becomes four times larger, and this allows the toner amount supplied from the sub hopper 42Y to the storage 241 of the developing device 24Y to remain as an appropriate value.

<Modified Embodiment>

In the embodiment of the present invention, the MFP 100 is an image forming apparatus of a type using a sub hopper. Specifically, toner is supplied from the toner bottle 41Y and the sub hopper 42 to the storage 241 of the developing device 24Y. There is another image forming apparatus of a type using a toner cartridge. The image forming apparatus of a type using a toner cartridge, like the MFP 100, supplies toner to the developing device 24Y. In this case, the toner cartridge is used in place of the toner bottle 41Y and the sub hopper 42, and toner is supplied from the toner cartridge to the storage 241 of the developing device 24Y.

Figure 12:
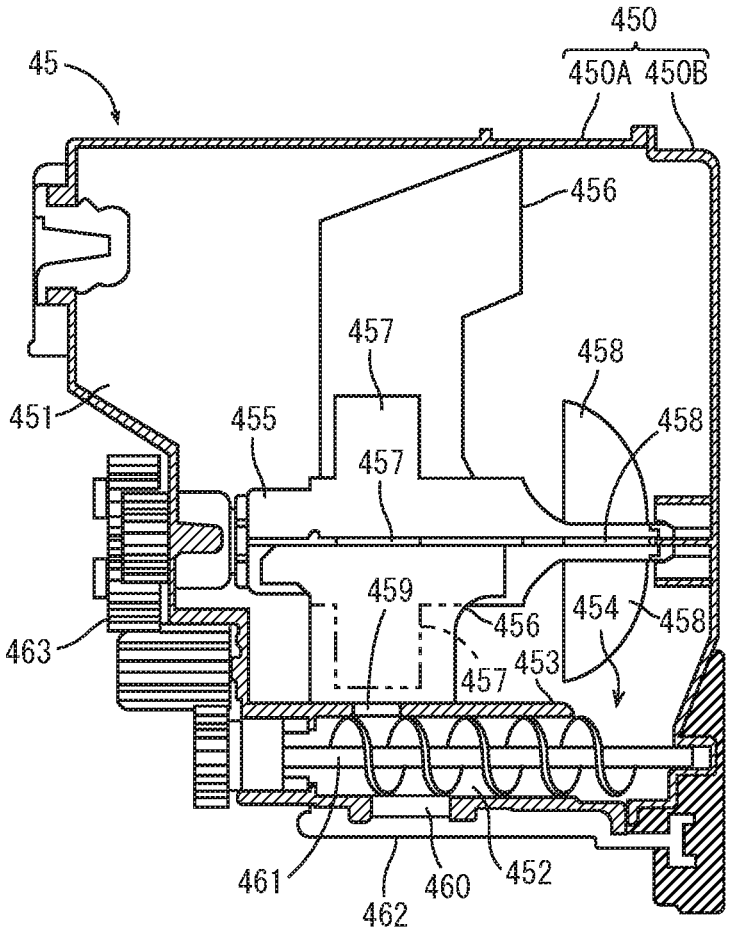
FIG. 12 is a cross-section view schematically showing a configuration of a toner cartridge.

FIG. 12 is a cross-section view schematically showing a configuration of a toner cartridge. As described later, words denoting a specific direction or position (such as "left and right", "up and down" and "front and rear") are based on the directions indicated in FIG. 12. FIG. 12 is a view of the toner cartridge viewed from the left direction, assuming that the front side of the toner cartridge is on the left side of a plane view.

A toner cartridge 45 having a configuration as shown in FIG. 12 is arranged according to each of colors: yellow, magenta, cyan and black. Hereinafter, a case where the toner cartridge 45 supplies toner of yellow will be described as an example.

The toner cartridge 45 includes a main case 450 in which a back side of an opening face of a front-side case member 450A and a front side of an opening face of a back-side case member 450B are attached to each other in a superimposed manner. The main case 450 is provided with a toner storage 451 storing toner in an upper part thereof, and provided with a toner conveyance portion 452 in a lower part of the toner storage 451 via a partition 453.

A gap between a back end of the partition 453 and a back surface of the back-side case member 450B forms a toner supply port 454 which connects a space in the toner storage 451 and a space in the toner conveyance portion 452 to each other. The toner storage 451 includes a stirring screw 455 with a shaft having an axis direction of the forth and back direction. The stirring screw 455 is provided at the center thereof with a Mylar sheet 456 and an air stirring paddle 457 which are extended facing an outer side in a radial direction, and is provided at a back end thereof with a cross-linking preventing paddle 458 which is extended facing an outer side in a radial direction.

The partition 453 is provided with an air hole 459 which is opened beneath the air stirring paddle 457. Further, the front-side case member 450A includes a toner supply port 460 whose lower side face is opened, and a shutter 462 which covers over the toner supply port 460. The toner conveyance portion 452 is provided with a conveyance screw 461 with a shaft having an axis direction of the forth and back direction. Further, the front-side case member 450A is provided at a front outer side thereof with a docking gear 463 having a group of gears for transmitting driving power to the stirring screw 455 and the conveyance screw 461. The docking gear 463 is connected to a docking gear of a main body of the apparatus, and this allows the stirring screw 455 and the conveyance screw 461 to be driven for rotation.

In the toner cartridge 45, the stirring screw 455 is driven for rotation, so that the Mylar sheet 456 above the partition 453 and the cross-linking preventing paddle 458 above the toner supply port 454 rotate. Therefore, the rotations of the Mylar sheet 456 and the cross-linking preventing paddle 458 cause toner stored in the toner storage 451 to be stirred. This allows preventing cross-linking and aggregation of the toner stored in the toner storage 451. As a result, the toner stored in the toner storage 451 is supplied to the toner conveyance portion 452 through the toner supply port 454, while being maintained in a powdery state.

Further, since the conveyance screw 461 rotates in the toner conveyance portion 452, the toner supplied from the toner supply port 454 is pushed forward by a wing of the conveyance screw 461 so as to be moved to the toner supply port 460 ahead of the toner supply port 454. On this occasion, in the case where the toner supply port 460 is opened by the shutter 462, the toner conveyed to the toner supply port 460 by the conveyance screw 461 is supplied to the storage 241 of the developing device 24Y through a toner conveyance member. In the case where the toner cartridge 45 is used here, the number of rotations of the conveyance screw 461 corresponds to the driving amount.

As mentioned above, the MFP 100 in the present embodiment functions as an image forming apparatus, including: the image forming unit 20Y which forms an image on a sheet of paper with toner stored in the storage 241; the sub hopper 42Y which supplies toner to the storage 241 by driving the sub hopper driving member 426; and the density detecting sensor 27Y which measures density of the image formed on the photoreceptor drum 23Y. The CPU 111 is capable of: predicting the toner consumption of the image forming unit 20Y based on data of the image targeted for image forming; controlling to cause the image forming unit 20Y to form an image having a predetermined density on the photoreceptor drum 23Y at a timing when the toner consumption becomes equal to or more than the first threshold value; correcting the driving amount of the sub hopper driving member 426 based on the density measured by the density detecting sensor 27Y; and in response to an event that the predetermined condition is satisfied, changing the first threshold value defining a timing when the density detecting sensor 27Y measures density. Therefore, the patch image having the predetermined density is formed on the photoreceptor drum 23Y at a timing when the toner consumption becomes equal to or more than the first threshold value, the density of the patch image formed on the photoreceptor drum 23Y is measured by the density detecting sensor 27Y, and the driving amount of the sub hopper driving member 426 is corrected based on the measured density. Therefore, since the driving amount of the sub hopper driving member 426 is corrected at a timing when the toner consumption becomes equal to or more than the first threshold value, it is possible to maintain the toner amount stored in the storage 241 to be an appropriate amount. Further, since a timing when the patch image is formed and the density of the patch image is measured is changed in response to an event that the predetermined condition is satisfied, a timing when the driving amount of the sub hopper driving member 426 is changed so that the driving amount can be determined according to a change of the amount of toner supplied based on the driving amount of the sub hopper driving member 426 to the storage 241. Therefore, it is possible to maintain the toner amount stored in the storage 241 to be an appropriate amount, which allows printing quality to become stable.

Further, since the MFP 100 changes to a timing when a frequency of forming the patch image and measuring the density of the patch image is increased, the frequency of forming the patch image and measuring the density of the patch image is increased so that, in the case where the change of the amount of toner supplied based on the driving amount of the sub hopper driving member 426 to the storage 241 is large, it is possible to quickly respond to the change to determine the driving amount of the sub hopper driving member 426.

Meanwhile, the CPU 111 included in the MFP 100 is capable of: determining the driving amount of the sub hopper driving member 426 based on the standard driving amount defined according the toner per unit as well as on the toner consumption predicted based on the image data; supplying toner to the storage 241 by driving the sub hopper driving member 426 according only to the determined driving amount; predicting the toner density of the storage 241 based on the measured density of the patch image; and correcting the standard driving amount based on the predicted toner density. Therefore, it is possible to correct a difference between the toner consumption predicted based on the image data and the supplied amount of toner actually supplied by the sub hopper driving member 426 to the storage 241.

Since the CPU 111 included in the MFP 100 changes the first threshold value in the case where the correction amount of the standard driving amount becomes equal to or more than the second threshold value, an amount of toner consumed until the standard driving amount is corrected may be decreased. This allows quickly responding to a large change of the amount of toner supplied based on the driving amount of the sub hopper driving member 426 to the storage 241.

Since the CPU 111 included in the MFP 100 changes a timing when the standard driving amount is corrected in the case where the non-operation period during which the image forming unit 20Y is not driven becomes greater than a predetermined period. In the case where toner in the storage 241 does not move beyond the predetermined period, liquidity of toner stored in the storage 241 may be changed. In preparation for an event that liquidity of toner is changed, the timing when the standard driving amount is corrected may be changed so that it is possible to determine the driving amount according to the change of the amount of toner supplied based on the driving amount of the sub hopper driving member 426 to the storage 241.

Further, the CPU 111 included in the MFP 100 changes a timing when density is measured in the case where a change amount of the environment variable including the temperature and/or the humidity becomes greater than a predetermined value. In the case where the change amount of the temperature and/or the humidity becomes greater than a predetermined value, liquidity of toner may be changed. In preparation for an event that liquidity of toner is changed, the timing when the standard driving amount is corrected may be changed so that it is possible to determine the driving amount according to the change of the amount of toner supplied based on the driving amount of the sub hopper driving member 426 to the storage 241.

<Appendix>

(1) The image forming apparatus according to any one of claims 2 to 7, wherein the toner supplier supplies toner to the storage in order that toner density of toner stored in the storage becomes within a predetermined range.

(2) The image forming apparatus according to any one of claims 2 to 7, wherein the toner supplier includes a housing portion which stores toner, and supplies toner stored in the housing portion to the storage by driving the conveyance member.

Although embodiments of the present invention have been described and illustrated in detail, it is clearly understood that the same is by way of illustration and example only and not limitation, the scope of the present invention should be interpreted by the terms of the appended claims.

What is claimed is:

1. An image forming apparatus comprising:

a storage that stores toner;

an image former that forms an image on an image carrying member with toner stored in the storage;

a toner supplier that supplies toner to the storage by driving a conveyance member;

a density measurer that causes the image former to form an image having a predetermined density at a predetermined timing, and measures a density of the formed image;

a corrector that corrects, in response to measurement of the density by the density measurer, a driving amount of the conveyance member based on the measured density;

a changer that changes, based on satisfaction of a predetermined condition, a timing when the density measurer measures the density; and a consumption predictor that predicts toner consumption by the image former based on image data targeted for image forming, wherein:

the toner supplier determines a driving amount of the conveyance member based on (i) a standard driving amount determined for supplying a unit amount of toner and (ii) the predicted toner consumption, and supplies toner to the storage by driving the conveyance member according only to the determined driving amount; and the corrector predicts toner density in the storage based on the measured density, and corrects the standard driving amount based on the predicted toner density.

2. The image forming apparatus according to claim 1, wherein the changer changes the timing such that a frequency with which the density measurer measures the density is increased.

3. The image forming apparatus according to claim 1, wherein:

the predetermined timing is a timing when the toner consumption predicted by the consumption predictor after the density measurer has detected the density becomes equal to or more than a first threshold value;

the predetermined condition is a condition that a correction amount of the standard driving amount corrected by the corrector becomes equal to or more than a second threshold value; and the changer changes the first threshold value.

4. The image forming apparatus according to claim 3, wherein the changer changes the first threshold value to a smaller value in a case where the correction amount becomes equal to or more than the second threshold value.

5. The image forming apparatus according to claim 3, wherein the predetermined timing is a timing when an accumulation of predicted toner consumption becomes equal to or more than the first threshold value.

6. The image forming apparatus according to claim 1, wherein the predetermined condition includes a case where a non-operation period during which the image former is not driven becomes greater than a predetermined period.

7. The image forming apparatus according to claim 1, further comprising:

an environment variable detector that measures an environment variable including at least one of a temperature and a humidity, wherein the predetermined condition includes a case where a change amount of the measured environment variable becomes greater than a predetermined value.

8. A toner supply method performed by an image forming apparatus, the image forming apparatus comprising a storage that stores toner, an image former that forms an image on an image carrying member with toner stored in the storage, and a toner supplier that supplies toner to the storage by driving a conveyance member, and the toner supply method comprising:

a density measuring step of causing the image former to form an image having a predetermined density at a predetermined timing, and measuring a density of the formed image;

a correction step of correcting, in response to measurement of the density in the density measuring step, a driving amount of the conveyance member based on the measured density;

a change step of changing, based on satisfaction of a predetermined condition, a timing when the density is measured in the density measuring step;

a consumption predicting step of predicting toner consumption by the image former based on image data targeted for image forming; and a driving control step of determining a driving amount of the conveyance member based on (i) a standard driving amount determined for supplying a unit amount of toner and (ii) the predicted toner consumption, and driving the conveyance member according only to the determined driving amount in order to cause the toner supplier to supply toner to the storage, wherein the correction step includes a step of predicting toner density in the storage based on the measured density, and correcting the standard driving amount based on the predicted toner density.

9. The toner supply method according to claim 8, wherein the change step changes the timing such that a frequency with which the density is measured in the density measuring step is increased.

10. The toner supply method according to claim 8, wherein:

the predetermined timing is a timing when the toner consumption predicted in the consumption predicting step after the density has been detected in the density measuring step becomes equal to or more than a first threshold value;

the predetermined condition is a condition that a correction amount of the standard driving amount corrected in the correction step becomes equal to or more than a second threshold value; and the change step includes a step of changing the first threshold value.

11. The toner supply method according to claim 10, wherein the change step includes a step of changing the first threshold value to a smaller value in a case where the correction amount becomes equal to or more than the second threshold value.

12. The toner supply method according to claim 10, wherein the predetermined timing is a timing when an accumulation of predicted toner consumption becomes equal to or more than the first threshold value.

13. The toner supply method according to claim 8, wherein the predetermined condition includes a case where a non-operation period during which the image former is not driven becomes greater than a predetermined period.

14. The toner supply method according to claim 8, further comprising:

an environment variable detecting step of measuring an environment variable including at least one of a temperature and a humidity, wherein the predetermined condition includes a case where a change amount of the measured environment variable becomes greater than a predetermined value.

15. A non-transitory computer-readable recording medium encoded with a toner supply program executed by a hardware processor that controls an image forming apparatus, the image forming apparatus comprising a storage that stores toner, an image former that forms an image on an image carrying member with toner stored in the storage, and a toner supplier that supplies toner to the storage by driving a conveyance member, and the toner supply program causing the hardware processor to perform:

a density measuring step of causing the image former to form an image having a predetermined density at a predetermined timing, and measuring a density of the formed image;

a correction step of correcting, in response to measurement of the density in the density measuring step, a driving amount of the conveyance member based on the measured density;

a change step of changing, based on satisfaction of a predetermined condition, a timing when the density is measured in the density measuring step;

a consumption predicting step of predicting toner consumption by the image former based on image data targeted for image forming; and a driving control step of determining a driving amount of the conveyance member based on (i) a standard driving amount determined for supplying a unit amount of toner and (ii) the predicted toner consumption, and driving the conveyance member according only to the determined driving amount in order to cause the toner supplier to supply toner to the storage, wherein the correction step includes a step of predicting toner density in the storage based on the measured density, and correcting the standard driving amount based on the predicted toner density.

* * * * *